United States Patent [19]

Soehngen et al.

[11] 4,093,404

[45] June 6, 1978

[54] APPARATUS FOR PREPARATION OF MATRICES CONTAINING FRANGIBLE PARTICULATE MATTER

[75] Inventors: John W. Soehngen; Albert Gerken, both of Berkeley Heights, N.J.

[73] Assignee: Celanese Corporation, New York, N.Y.

[21] Appl. No.: 642,639

[22] Filed: Dec. 19, 1975

[51] Int. Cl.[2] ..... F04B 9/00

[52] U.S. Cl. ..... 417/317; 417/454; 417/507; 417/536

[58] Field of Search ..... 415/72, 177, 178; 417/317, 507, 339, 415, 454, 502, 503, 534–537; 92/128; 222/146, 146 C; 137/565, 567, 604; 23/252 R; 118/7, 8; 260/37 M; 141/100, 104, 105, 107

[56] References Cited

U.S. PATENT DOCUMENTS

| | | | |
|---|---|---|---|
| 894,048 | 7/1908 | Petsche | 417/507 |
| 1,136,957 | 4/1915 | Hettinger | 415/178 X |
| 1,552,068 | 9/1925 | Lee | 417/415 |
| 1,564,819 | 12/1925 | Birch | 417/536 |
| 1,829,144 | 10/1931 | Kaiser | 417/415 |
| 2,191,450 | 2/1940 | Campbell | 415/72 |
| 2,411,971 | 12/1946 | MacMillin et al. | 415/72 |
| 2,923,438 | 2/1960 | Logan et al. | 141/104 X |
| 3,009,442 | 11/1961 | Juvinall | 417/429 |
| 3,100,506 | 8/1963 | Breer | 23/252 R |
| 3,207,083 | 9/1965 | Lohry et al. | 417/454 |
| 3,323,461 | 6/1967 | Bennett | 417/339 |
| 3,462,300 | 8/1969 | Hocutt | 417/317 |
| 3,612,729 | 10/1971 | Commarmot | 417/415 |

FOREIGN PATENT DOCUMENTS

| | | | |
|---|---|---|---|
| 869,466 | 2/1942 | France | 417/507 |
| 1,139,160 | 6/1957 | France | 417/507 |

*Primary Examiner*—William L. Freeh
*Assistant Examiner*—Edward Look

[57] ABSTRACT

A double acting metering pump is disclosed for use in apparatus to prepare matrices containing frangible particulate material. The double acting pump provides a metered output of matrix containing frangible particulate material which is mixed with a parent matrix from an extruding apparatus in a downstream static mixer. The pump includes pneumatically actuated valves that control the flow of matrix to each of two alternately discharged pumping chambers. The pump is facilely disassembled for cleaning and is surrounded by a heating jacket to maintain an essentially uniform temperature in the matrix during pumping.

26 Claims, 7 Drawing Figures

APPARATUS FOR PREPARATION OF MATRICES CONTAINING FRANGIBLE PARTICULATE MATTER

CROSS REFERENCE TO RELATED APPLICATIONS

This application contains metering apparatus suitable for use in a process for manufacturing powder paint as disclosed in U.S. patent application Ser. No. 642,415 for "Process for Preparing Shear Degradable Particle-Containing Resin Powders" filed Dec. 19, 1975 now U.S. Pat. No. 4,057,607 by John W. Soehngen and Martin J. Hannon which application is owned by the assignee hereof and expressly incorporated herein by this reference.

BACKGROUND OF THE INVENTION

This invention relates generally to apparatus for preparing matrices having frangible particulate material. More particularly, this invention concerns an easily cleaned, double acting metering pump asembly for supplying a molten matrix containing frangible particulate material to a molten parent matrix for mixing in a static mixing device.

The automobile industry makes extensive use of metallic paints having frangible particles of aluminum, for example, which exhibit a high luster when applied as a surface finish. These metallic paints are often applied as a powder in a spraying operation and cured by subsequent exposure to heat.

In the preparation of metallic paints, the aluminum particulate material has, in the past, been extruded along with the parent matrix so that a homogeneous dispersion of the particulate material results. The extrusion operation, however, exerts high shear forces on the relatively small frangible particles. Typically the particles are planar flakes that exhibit the desired reflective properties. The high shear forces have caused the planar particulate material to be bent, torn and otherwise damaged so that when the resulting metallic paint is applied to a surface an undesirable proportion of spurious reflections is obtained and the lustrous properties of the finish are deleteriously affected.

It has been found, as disclosed in the copending application noted above, that separation of the mixing and the extrusion processes can lead to markedly improved properties in the final product. The referenced application discloses an intermittently operable metering pump for supplying a molten matrix containing the frangible particulate material to a static mixing device wherein the frangible particulate material is homogeneously mixed with a flow of molten parent matrix from an extruding apparatus. The intermittent operation of the disclosed application is undesirable since it requires periodic charging of the metering apparatus and the concommitant delay.

Another persistent problem has been the effect of a metering pump on the frangible particles where mixing is not done in the extruder. Often, a gear pump is used which exposes an undesirably high portion of the particles to high shear forces between the gears and between the gears and the pump housing.

Accordingly, the need continues to exist for metering apparatus which is capable of overcoming the intermittent deficiencies of previous devices while avoiding the deleterious influence of high shear forces on frangible planar particulate material.

OBJECTS AND SUMMARY OF THE INVENTION

It is, therefore, a general object of the present invention to provide novel apparatus for preparation of matrices containing frangible particulate material which overcomes problems of the type discussed above.

It is a more particular object of the present invention to provide a novel double acting metering pump assembly for use in such apparatus.

It is another object of the present invention to provide a novel metering pump which is adapted for facile disassembly and easy cleaning and which does not induce excessive shear forces on frangible particles of a molten matrix processed thereby.

Yet another object of the present invention is to provide a novel double acting pump which is adapted to provide a generally uniform thermal environment for a plasticized matrix being handled thereby.

A further object of the present invention is to provide a variable speed metering pump assembly having pneumatically actuated valves controlled by valve actuating means and including a cylinder having axially displaceable end plate means which can be removed to facilitate cleaning thereof.

Still another object of the present invention is to provide a novel pump having a controlled delivery of molten matrix containing frangible particulate material while substantially avoiding loss of and damage to the frangible particles.

In accordannce with a preferred embodiment of the present invention, apparatus for preparing molten matrices containing frangible particulate material preferably has a parent matrix supply means, a reservoir for supplying a flow of frangible particulate material and mixing means for dispersing the flow of frangible particulate material in a parent matrix supplied by the matrix supply means. A reciprocable pump means is disposed between the reservoir means and the mixing means and has first and second pumping chambers alternately operable to continuously meter the flow of frangible particulate material without substantial impairment thereof.

A suitable manifold means for the flow of resin containing particulate material communicates with the reservoir means and with both the first and second pump chambers. The manifold means includes a discharge opening communicating with the mixing means.

A control means cooperates with the manifold means to alternately divert the flow from the reservoir to one of the first and second pumping chambers while simultaneously connecting the other of the first and second pumping chambers with the discharge opening and therefore the mixing means.

To permit variable metered rates, a variable speed drive means may be connected to the pump means. The drive means reciprocates a piston disposed between the first and second pumping chambers at a uniform rate which may be selected.

A heating means may be disposed around a housing for the pumping chambers to provide a substantially uniform thermal environment for the matrix containing particulate material as it is processed by the reciprocable pump means. A plurality of heating elements may be used in the heating means to regulate the temperature thereof.

To implement the desirable features of facile disassembly and easy cleaning, the reciprocable pump means preferably includes a cylinder having coaxial bore with a piston reciprocably disposed therein and closed by a pair of end members. The manifold means includes supply manifold means having a length substantially coextensive with a cylinder means and having a conduit which communicates with the reservoir. The manifold means also includes a discharge manifold means substantially coextensive with the cylinder means and having a conduit communicating with the mixing means.

Each end member has openings for slidably receiving one end of the cylinder, one end of the supply manifold means and one end of the discharge manifold means. Each end member also includes internal passages to effect fluid communication between the discharge manifold means, the supply manifold means and the cylinder means. Suitable longitudinal clamp means is provided to hold the end members, the supply manifold means, the discharge manifold means and the cylinder together during operation of the pump means.

BRIEF DESCRIPTION OF THE DRAWINGS

The above and many other objects of the present invention will be apparent to those skilled in the art when this specification is read in conjunction with the appended drawings wherein like reference numerals have been applied to like elements and wherein.

DESCRIPTION OF THE PREFERRED EMBODIMENT

Figures 1, 2:
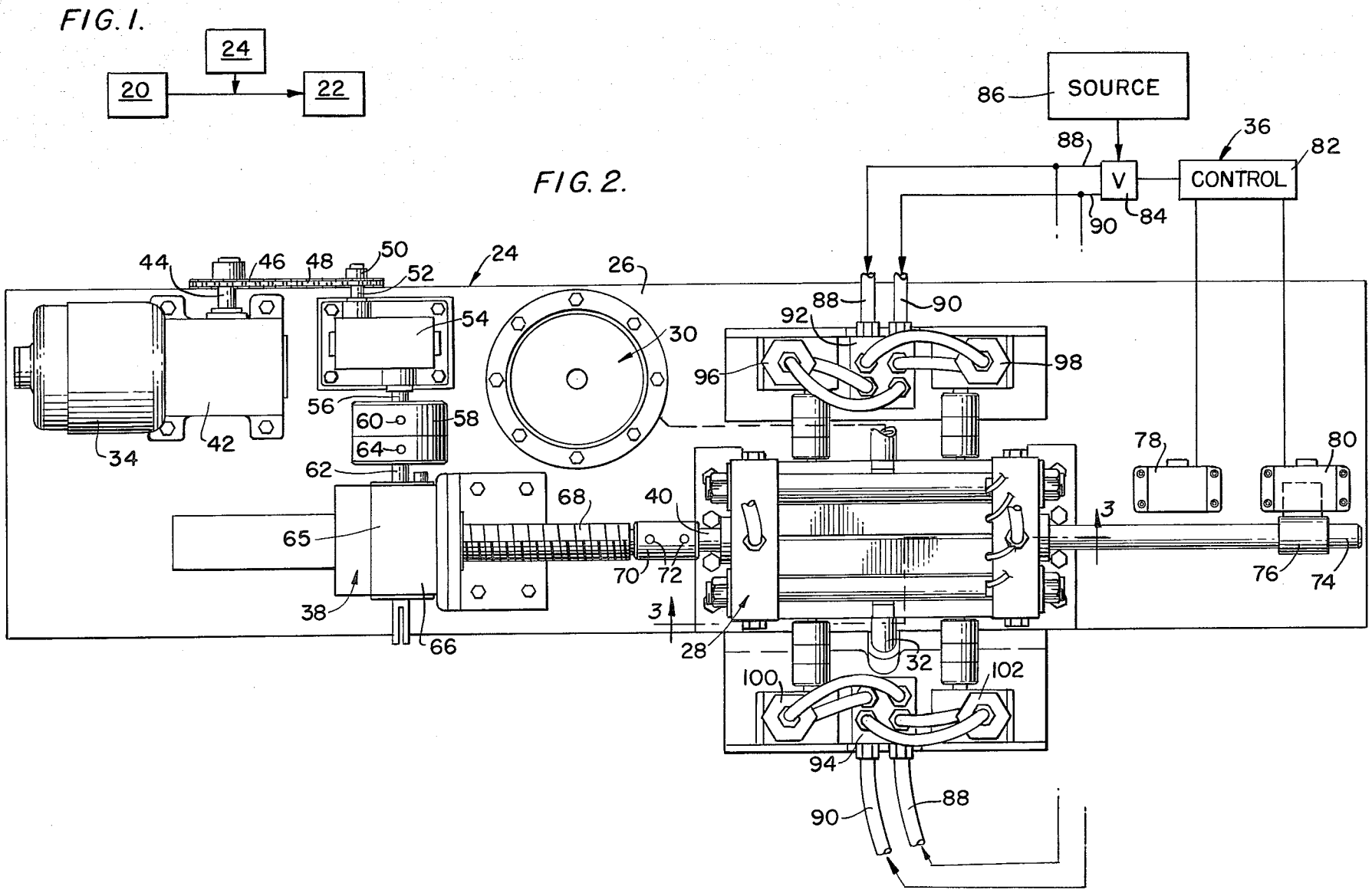
FIG. 1 is a schematic illustration of the apparatus in which a metering pump assembly according to the present invention may be used.
FIG. 2 is a plan view of the metering pump according to the present invention.

Turning now to FIG. 1 a suitable conventional extruding machine 20 provides a parent flow of plasticized synthetic resinous matrix material to a static mixing device 22. A matrix or vehicle containing frangible particulate material, such as aluminum flakes, is supplied from a source 24, introduced downstream of the extruding machine 20, and allowed to mix with the parent matrix in the static mixing apparatus 22. The product which leaves the mixing device 22 comprises the parent matrix with the frangible particulate material and its vehicle homogeneously dispersed throughout.

With reference now to FIG. 2, the source 24 which supplies the flow of molten matrix containing frangible particulate material is illustrated in greater detail. The source 24 includes a base member 26 which may be adapted for mounting above the output end of an extruding machine 20.

A double acting reciprocating metering pump apparatus 28 having a pair of pumping chambers is suitably mounted on the base 26 and receives the matrix containing the frangible particulate material from a reservoir assembly 30 and dischares a metered flow through a conduit 32 which communicates with the static mixing apparatus 22 (FIG. 1).

Disposed toward one end of the base member 26 (FIG. 2) is a reversible variable speed motor 34 which provides a mechanical drive for reciprocating the pump apparatus 28. The motor 34 may have a power rating of ¼ hp. and may be operable to provide output speed in the range of 5 to 120 RPM. Preferably motor output speed lies in the range of 5 to 30 RPM. A control assembly 36 may be disposed at another end of the base member 26 for cooperation with the pump assembly 28 to control the flow of matrix containing frangible particulate material from the reservoir assembly 30 to the discharge conduit 32. The control assembly 36 alternately diverts the matrix from the reservoir assembly 30 to each of the two pumping chambers.

A drive system 38 interconnects the variable speed motor 34 and a reciprocating piston shaft 40 of the pump apparatus 28. The drive system 38 is operable to convert a rotary motion of the motor 34 into linear motion of the piston shaft 40.

The drive system 38 may include a first reducing gear box 42 directly connected to the motor 34 and having an output shaft 44 which rotates at a reduced speed relative to the motor 34. The first gear box 42 also provides a right angle drive with respect to the axis of the motor 34.

The output shaft 44 is provided with a suitable chain drive sprocket 46 which is in driving relationship with an endless chain 48. The endless chain 48 connects the drive sprocket 46 with an idling sprocket 50 carried by an input shaft 52 of the second reducing gear box 54. The drive sprocket 46 and the idling sprocket 50 may cooperate to increase the output speed and may have teeth that give a 1:1.5 sprocket ratio.

The second reducing gear box 54 may effect a speed reduction of 16:1 and has an output shaft 56 which is partially received within a shaft coupling 58 and is secured against rotation with respect thereto by a suitable shear pin 60. In general coaxial alignment with the output shaft 56 is a drive shaft 62 which is also received in the shaft coupling 58 and connected thereto against rotation by a suitable shear pin 64.

Rotary motion of the drive input shaft 62 (FIG. 2) is converted into a linear motion of the threaded output shaft 68 by a suitable conventional motion converter 66.

One conventional manner of effecting this transformation of rotary to linear motion would be to provide a suitable worm gear on the drive shaft 62 within the housing 65 of the converter 66. The worm gear may cooperate with peripheral teeth of an internally threaded spur gear which is constrained from displacement along its axis of rotation. The internal threads of the spur gear cooperate with and engage threads of the externally threaded shaft 68. Accordingly, rotation of the worm gear rotates the spur gear which, in turn, causes translation of the shaft 68 by virtue of the threaded connection therebetween.

The distal end of the shaft 68 and one end of the piston shaft 40 are connected in coaxial relationship by a shaft coupling 70. The shaft coupling 70 is provided with a pair of conically tapered shear pins 72 to prevent relative rotation between the coupling 70 and each of the respective shafts 40, 68. The conically tapered shear pins 72 are easily removed when it is necessary to disconnect the shaft 68 and the piston shaft 40.

With continued reference to FIG. 2, the second end 74 of the piston shaft 40 may be provided with a transversely extending vane 76 which is suitably attached to the shaft 40 so that the vane is not longitudinally or rotationally displaceable with respect thereto. The vane 76 extends transversely of the shaft 40 and cooperates with a pair of limit switches 78, 80 which constitute a position sensing assembly.

The limit switches 78, 80 are fastened to the base portion 26, are spaced to correspond with the stroke of the piston shaft 40 and define the extremes or axial limits of travel for the piston shaft 40. The limit switches 78, 80 are provided with a generally horizontal slot which is aligned with the vane 76 such that the vane 76 is received within the slot as it reaches one extreme of its longitudinal travel.

The limit switches 78, 80 provide position indicating input signals to a control circuit 82 of the control means 36 and comprise a portion of the control apparatus 36. When the control circuit 82 receives a signal from the limit switches 78, 80 indicating that the piston shaft 40 is at one end of its stroke, the control circuit 82 generates a signal to the variable speed motor 34 causing it to reverse its direction of rotation. Reversal of the motor 34 at the limit switches 78, 80 causes the piston shaft 40 to reciprocate between the positions of the switches 78, 80.

As the piston shaft 40 reaches one of its longitudinal extremes the control circuit 82 (FIG. 2) also generates a signal to a suitable conventional electrically actuated valve 84. The valve 84 alternately connects a source of pressurized fluid 86 with each of a pair of pneumatic manifolds 88, 90 and may connect the other of the manifolds 88, 90 to an exhaust vent. Each of the pneumatic manifolds 88, 90 communicates with two manifold blocks 92, 94 one of which is mounted on each side of the pump assembly 28.

The manifold blocks 92, 94 provide a convenient means for splitting the flow from each manifold 88, 90 into actuator supply lines. Each manifold block 92, 94 has a pair of input connectors: one for each of the pneumatic manifolds 88, 90. In addition, each manifold block 92, 94 is provided with four actuator supply connections: two actuator supply connections are in fluid communication with each of the input connectors. Each manifold block 92, 94 supplies pneumatic fluid to two double acting pneumatic rotary actuators 96, 98, 100, 102.

Figure 3:
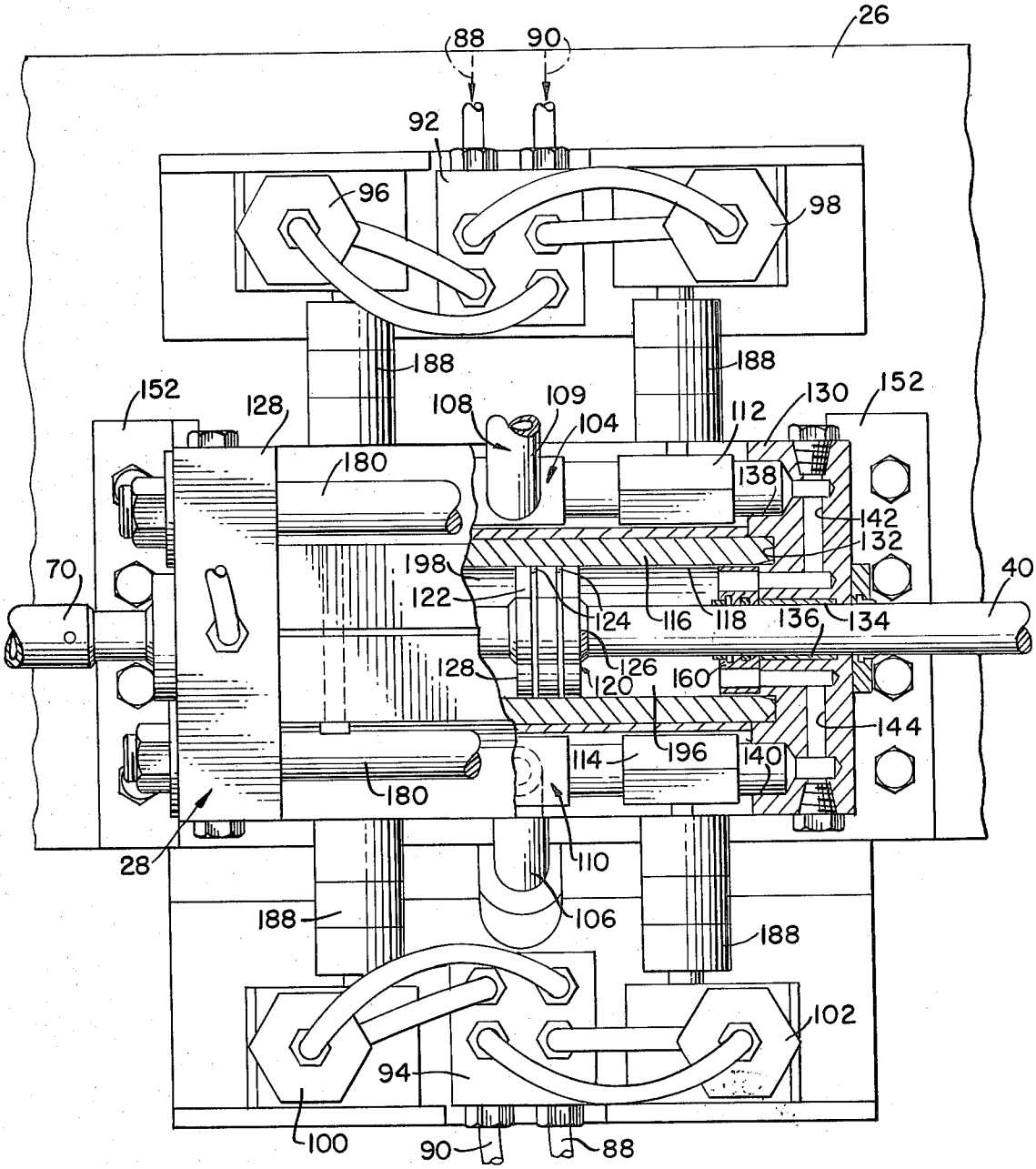
FIG. 3 is a plan view in partial cross section illustrating internal details of the pump assembly.

Turning now to FIG. 3 a manifold assembly 104 is provided which receives a flow of a matrix containing frangible particulate material from the reservoir and supplies it to the pump assembly 28 and which receives a metered flow of matrix from the pump assembly 28 and delivers it through an outlet conduit 106. The manifold assembly 104 includes a T-shaped supply manifold 108 and a T-shaped discharge manifold 110.

The supply manifold 108 has a central conduit 109 which is in fluid communication with the reservoir assembly. The supply manifold 108 has a supply valve assembly which includes a pair of suitable conventional ball valves 112 that are disposed in corresponding coaxially aligned branch conduits. Similarly, the discharge manifold 110 has the central discharge conduit 106 and a discharge valve assembly that includes a pair of ball valves 114 which are symmetrically disposed about the discharge conduit 106 in two coaxially aligned branch conduits.

Only one ball valve 112, 114 of each pair is illustrated; it is understood that the second ball valve in the discharge valve assembly is identical to the illustrated valve and is symmetrically disposed with respect thereto. Each ball valve 112, 114 is operable between an open position and a closed position.

The details of the double acting piston pump assembly 28 and the manner in which it is adapted for facile disassembly and easy cleaning will now be described. The pump assembly 28 includes a cylindrical barrel or housing 116 having a pair of end portions and a generally circular cross sectional configuration. The barrel or cylinder 116 includes a bore 118 which is generally coaxial with the longitudinal axis of the barrel 116.

Disposed within the bore 118 of the barrel 116 is a piston assembly 120 which includes the piston shaft 40 and a radially protruding piston 122 fixedly attached thereto for linear movement therewith relative to the barrel 116. The piston shaft 40 is coaxially positioned with respect to the barrel 116 and is longitudinally slidable therein. The peripheral surface 122 of the piston 120 may be provided with appropriate annular seals 124 and has a diameter that permits a sliding fit relative to the bore 118. The small radial tolerance between the bore 118 and the piston surface 122 also provides sealing between opposite radial faces 126, 128 of the piston 120.

The coaxially aligned branch conduits of the supply manifold 108 have a length substantially coextensive with the length of the barrel 116. Similarly, the coaxially aligned branch conduits of the discharge manifold 110 have a length substantially coextensive with the length of the barrel 116. The discharge manifold 110 and the supply manifold 108 are laterally spaced from the barrel 116 in a generally horizontal plane. The longitudinal axis of the barrel 116 and the axis of each branch conduit are generally parallel.

To hold the barrel 116 and the manifold assembly 104 together, a pair of end blocks 128, 130 and longitudinally extending tie rods 180 are provided. The two end blocks 128, 130 are substantially identical and it wil therefore suffice to describe one of the end blocks in detail.

The end block 130 (FIG. 3) is provided with an annular recess 132 which is adapted to slidingly receive a corresponding end of the barrel 116. The end block 130 is also provided with a shaft receiving opening or bore 134 which is coaxially positioned with respect to the annular recess 132 and adapted to slidably receive the piston shaft 40 and an appropriate shaft bushing 136.

Spaced laterally of the recess 132 in the end block 130 is a pair of parallel bores 138, 140 which are adapted to slidably receive and seal corresponding ends of the supply manifold and the discharge manifold 110 respectively. The end block 130 is also provided with an internal supply channel 142 and a discharge channel 144 which establish fluid communication between the corresponding parallel bore 138, 140 and the piston receiving bore 118 of the barrel 116.

Figure 4:
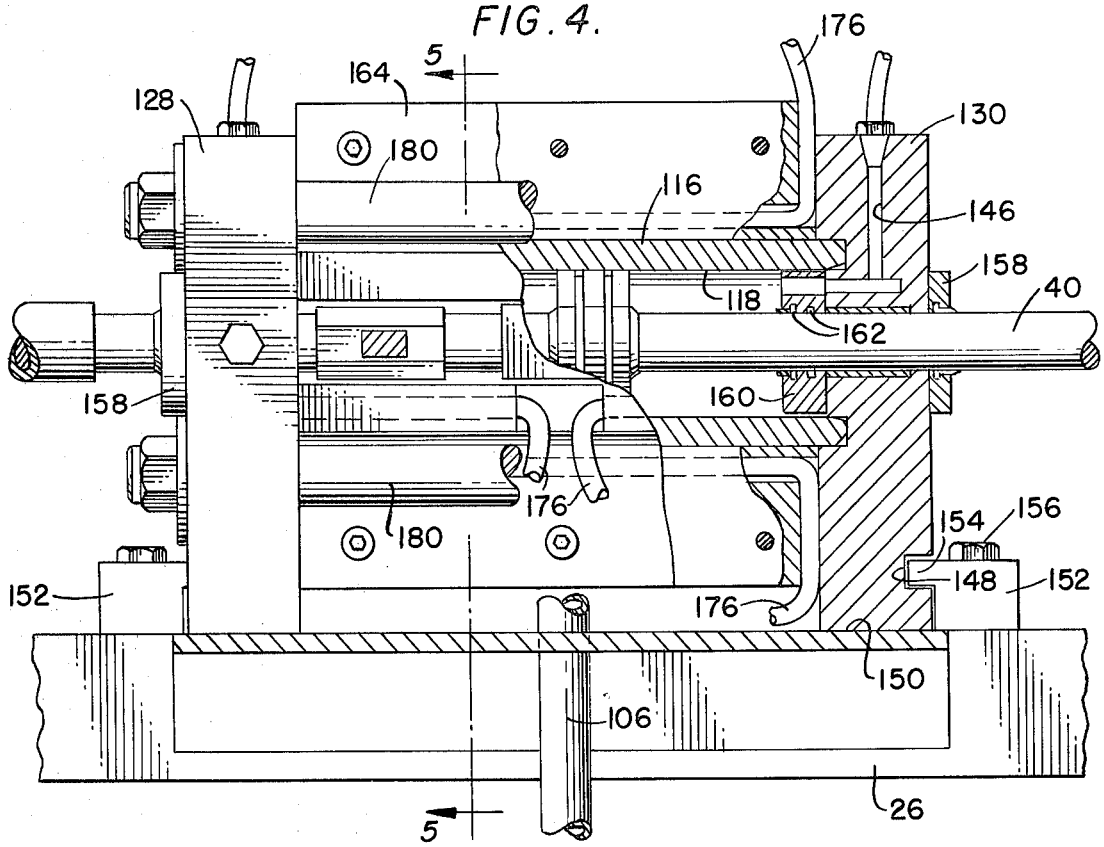
FIG. 4 is an elevational view in partial cross section of the pump assembly.

Turning now to FIG. 4, the end block 130 has a vertically extending channel 146 which communicates with the bore 118 of the cylinder 116 and provides a vent passage when needed.

A horizontally extending channel 148 is positioned adjacent the lower end 150 of the end block 130. The channel 148 cooperates with a tongue 154 of a mounting clamp 152 to mount the end block 130 securely to the base portion 26. A plurality of threaded fasteners 156 passing through the clamping member 152 and into the base portion 26 may be used to releasably mount the end blocks. The tongue 154 is preferably spaced from the base portion 26 by a distance slightly less than the distance between the lower edge of the horizontal slot 148 and the bottom edge of the block 130.

To prevent foreign matter from entering the pump assembly 28, a suitable scraper assembly 158 may be suitably affixed to the outside face of each end block 128, 130. The scraper assembly 158 surrounds the external circumference of the shaft 40.

Sealing between the shaft 40 and the end block 130 is provided by an internally disposed seal block 160 which is positioned within the bore 118 of the barrel 116 and suitably attached to the corresponding end block 128, 130. The seal block 160 has a port aligned with each of the channels 142, 144, 146 (see FIGS. 3 and 4). The seal block 160 is provided with O rings 162 disposed in annular channels adjacent to the shaft receiving opening to complete the seal.

Figure 6:
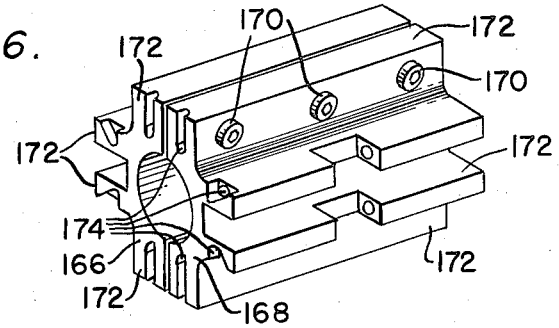
FIG. 6 is a perspective view of a heat sink used to equalize the thermal environment of the metering pump with other portions of the pump removed for the sake of clarity.

Disposed externally with respect to the barrel 116 is an aluminum heat sink 164 (see FIG. 4). The heat sink 164 includes a pair of longitudinally extending portions 166, 168 (see FIG. 6) which are clamped around the circumference of the barrel 116 by means of threaded fasteners 170. Each portion 166, 168 includes a plurality of generally radially extending fins 172. Each fin 172 is provided with a longitudinally extending opening 174 which is adapted to receive a cartridge type heating element.

Figure 5:
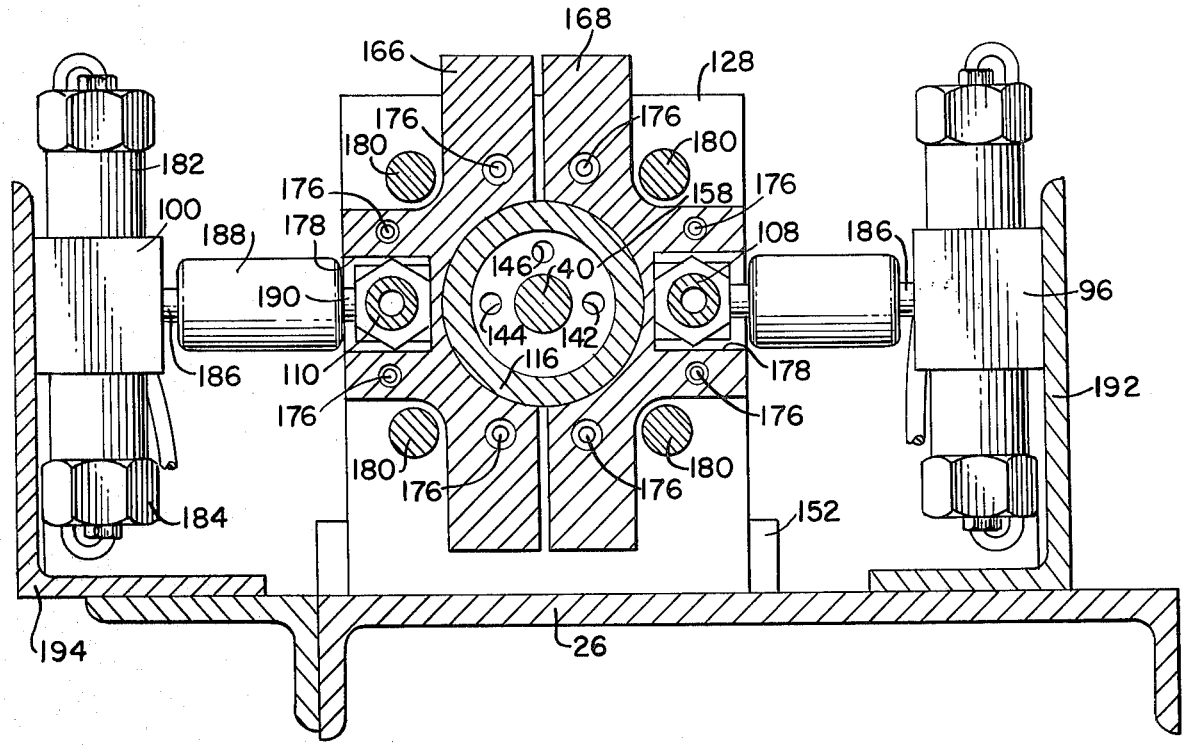
FIG. 5 is a view in partial cross section taken along the line 5—5 of FIG. 4.

Turning now to FIG. 5 it will be observed that a plurality of heating elements 176 are disposed circumferentially around the pump assembly 28 and radially outwardly of the barrel 116. Moreover, the portions 166, 168 of the heat sink have longitudinally extending channels 178 to receive the corresponding supply manifold 108 and the discharge manifold 110.

Disposed between fins of the heat sink elements 166, 168 are four elongated tie rods 180 which are substantially equiangularly spaced with respect to the piston shaft 40 and the barrel 116. Each tie rod 180 extends between the two end blocks 128, 130 (see FIG. 4) and serves to pull and clamp the end blocks 128, 130 toward one another. Simultaneously, the tie rods 180 hold the barrel 116 and the manifold assembly 104 together in fluid communicating relationship without exposure of any threaded surfaces to the matrix being pumped.

Each double acting pneumatic actuator 96, 98, 100, 102 (see FIG. 5) is provided with a pair of opposed actuating cylinders 182, 184. The opposed cylinders 182, 184 may have a piston rod extending therebetween with a gear rack thereon. A pinion meshing with the gear rack causes a shaft 186 to rotate when either cylinder is energized which in turn causes a shaft coupling 188 to rotate.

The shaft coupling 188 interconnects the shaft 186 of an actuator and the valve stem 190 of a corresponding ball valve in the manifold assembly. Accordingly, upon actuation of the cylinder 182, the valve stem 190 is positioned at one of the open and closed positions. Upon actuation of the cylinder 184, the valve stem 190 is positioned at the other of the open and closed positions. Each actuator 96, 100 is mounted on a corresponding bracket 192, 194 to position the operating shaft 186 in general coaxial alignment with the associated valve stem 190.

Figure 7:
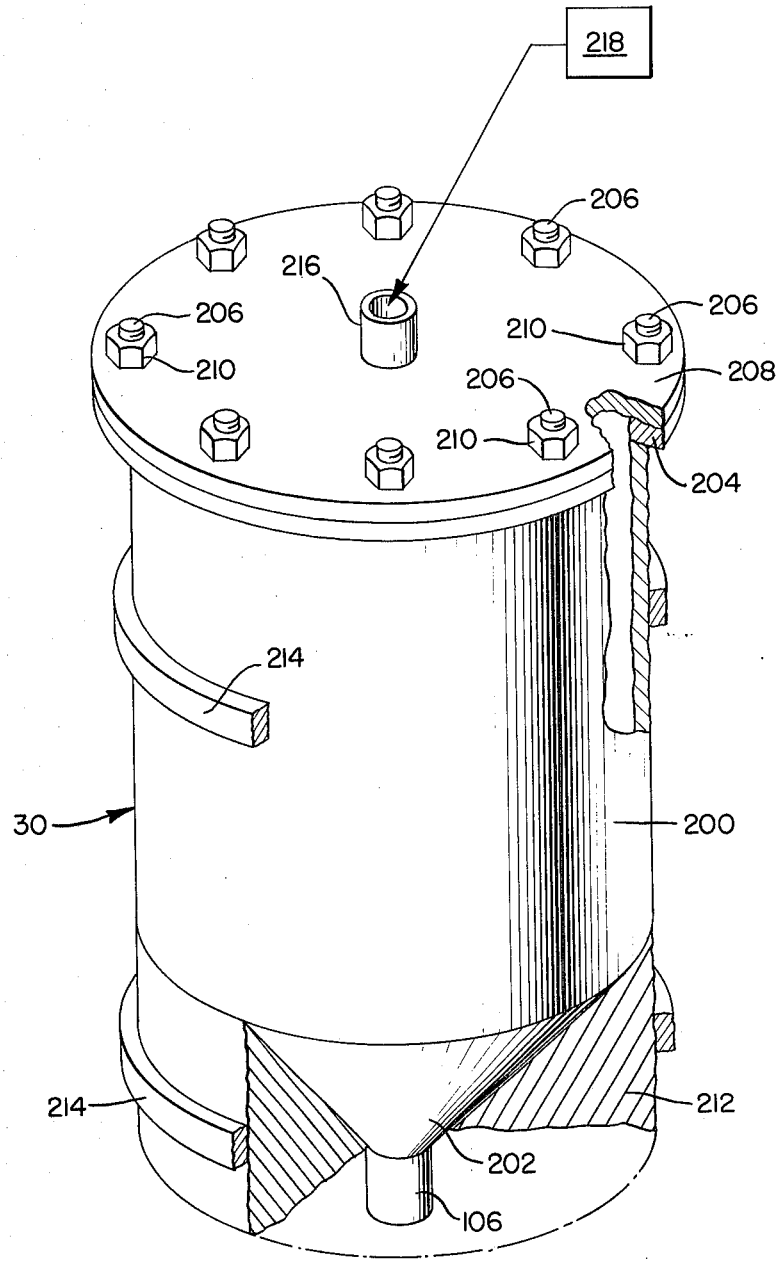
FIG. 7 is a view in partial cross section of a reservoir assembly.

Turning briefly to FIG. 7, the reservoir assembly 30 includes a tank portion 200 having a generally cylindrical sidewall and a conical end 202 which communicates with the central conduit 106 of the supply manifold. An upper end of the sidewall has a radially outwardly extending flange 204 with a plurality of bolt studs 206 extending therefrom. The bolt studs 206 are equiangularly spaced around the flange 204 and project beyond the sidewall.

A generally circular cover portion 208 is connected to the tank portion 200 at the flange 204. The cover portion 208 has a plurality of openings positioned to correspond to the bolt studs 206 so that the cover portion 208 slides over the studs 206. Suitable nuts 210 are fastened to the studs 206 to securely attach the cover portion 208 and the tank portion.

Disposed externally of the conical end 202 of the tank portion 200 is an annular aluminum heat sink 212 having a generally triangular cross section. The heat sink 212 assists in maintaining a uniform temperature in the reservoir assembly 30. To enable the reservoir assembly 30 to keep a molten matrix containing frangible particulate material sufficiently warm to be free flowing, one or more suitable conventional band heaters 214 may be wrapped around the circumference of the tank portion 200 and the heat sink 212.

At the center of the top portion 208 is a conduit 216 which communicates with a source 218 of inert gas under pressure. The inert gas may, for example, be nitrogen at a pressure of 5 to 10 psig. The low pressure gas assists the molten matrix to flow into the supply conduit 106.

The reservoir assembly 30 typically has an internal volumetric capacity much larger than the displacement of the cavity of the pump assembly 28. In this manner, the reservoir assembly 30 needs refilling only at infrequent conveniently spaced time intervals.

Returning now to FIG. 3, the barrel 116, the bore 118 thereof, the seal blocks 160, and the end blocks 128, 130 at opposite ends of the barrel 116, define a housing having an internal cavity. The radially extending faces 126, 128 of the piston 122 divide the cavity into a pair of pumping chambers 196, 198. The pumping chambers 196, 198 are substantially annular and are coaxially disposed with respect to one another. As the chamber 196 is volumetrically reduced by the piston assembly 120, matrix is pumped therefrom; simultaneously, the chamber 198 is volumetrically enlarged and is filled with a second supply of material. Accordingly, when the piston assembly 120 reaches one end of a stroke and begins a return stroke, the opposite pumping chamber becomes operative to pump fluid to the discharge conduit 106 and the first pumping chamber 196 begins filling in preparation for subsequent discharge at the end of the return stroke.

The matrix containing frangible particulate material passes through the central conduit 109, a branch conduit and valve 112 into the supply channel 142 of end block 128 and then into the first pumping chamber 198. Simultaneously, a metered flow of the matrix is expelled through the discharge passage 144 of the end block 130, the branch conduit and the valve 114 and then the discharge conduit 106. The valves 112, 114 in the other branch conduits are closed and do not permit flow. When the piston assembly 120 reverses its direction of movement, all four valves 112, 114 reverse position from open to closed and vice versa.

When the piston assembly 120 has reached the end of a stroke and it is desired to discontinue future pumping, the vent passage 146 communicating with the volumetrically contracted pumping chamber is opened. Accordingly, as the piston assembly 120 advances, the air or gas may be admitted to the pumping chamber so that the matrix need not be wasted.

When it is desired to disassemble the pump 28 for cleaning purposes, the shaft couplings 188 connecting the actuators 96, 98, 100, 102 to the manifold assembly 104 are disconnected to free the valve stems 190 therefrom. In addition, the piston shaft coupling 70 is disassembled, freeing the pump assembly 28 itself from the drive apparatus. The mounting brackets 152 are then released from the base portion 26 so that the entire pump assembly 28 may be lifted clear thereof.

The tie rods or clamping assemblies 180 may then be removed so that the end blocks 128, 130 may be axially removed from engagement with the barrel 116 and the manifolds 108, 110. In this manner the piston assembly 120 and the barrel 116 may be cleaned. The end blocks 128, 130 and the manifolds 108, 110 may also be cleaned in a very facile manner.

Apparatus constructed according to the present invention has been used to control the admixture of a first composition comprising acrylic resin and aluminum flakes and a second composition comprising acrylic resin and a suitable curing agent. Aluminum particles having two different size range distributions have been successfully regulated by the present apparatus without significant particle degradation. The respective size range distributions are given below as Examples I and II.

| Particle Size Range, Microns | Example I | Example II |
|---|---|---|
| 5.0 - 6.4 | 0.0% | 0.0% |
| 6.4 - 8.0 | 3.8 | 7.3 |
| 8.0 - 10.1 | 7.7 | 11.5 |
| 10.1 - 12.7 | 10.0 | 12.2 |
| 12.7 - 16.0 | 15.6 | 16.7 |
| 16.0 - 20.2 | 18.4 | 16.9 |
| 20.2 - 25.4 | 14.8 | 12.0 |
| 25.4 - 32.0 | 10.7 | 8.0 |
| 32.0 - 40.3 | 10.0 | 6.8 |
| 40.3 - 50.8 | 7.1 | 4.7 |
| 50.8 - 64.0 | 2.0 | 2.9 |
| 80.6 - 101.6 | 0.0 | 0.4 |
| 101.6 - 128.0 | 0.0 | 0.0 |
| 128.0 - 161.0 | 0.0 | 0.0 |
| 161.0 - 203.0 | 0.0 | 0.7 |
| Total | 100.0 | 100.0 |

During test runs, the heat sinks operated in the range of 110°-140° C., with the target operating temperature of 130° C. With the motor operating 5.8 RPM, an output flow rate of 1.15 gm/min. was obtained. With the motor operating at 28.8 RPM, output flow rate was measured at 4.51 gm/min.

It should now be apparent that a pump constructed in accordance with the present invention does not induce a high degree of shearing stress on frangible particulate material contained in a matrix which is pumped by the pump 28. In addition it will be apparent that the variable speed drive which is reversible affects a uniform degree of control over the rate at which material is expressed by the double acting pump 28.

It should now be apparent that there has been provided in accordance with the present invention a new and useful apparatus for use in manufacturing matrices containing frangible particulate material. Moreover, it will be apparent to those skilled in the art that many modifications, variations, substitutions and equivalents may be made for various features of the invention. Accordingly, it is expressly intended that all such variations, modifications, substitutions and equivalents which fall within the spirit and scope of the invention as defined in the appended claims be embraced thereby.

What is claimed is:

1. In matrix preparation apparatus having matrix supply means, reservoir means for supplying a flow of frangible particulate material, and mixing means for dispersing the flow of frangible particulate material in the matrix, the improvement being means for supplying the frangible particulate material to the mixing means comprising:

reciprocable pump means having a first annular pump chamber and a second annular pump chamber, coaxially alligned and alternately operable, for continuously pumping the flow of frangible particulate material at a uniform metered rate without substantial impairment of frangible particles;

manifold means communicating with the reservoir means, the mixing means and the first and second pump chambers, for conveying the flow from the reservoir means to one of the first and second pump chambers and from the other of the first and second pump chambers to the mixing means; and control means connected with the manifold means for diverting the flow from the reservoir means to the first and second pump chambers and for simultaneously connecting the first and second pump chambers with the mixing means such that one pump chamber communicates with the reservoir means while the other pump chamber communicates with the mixing means.

2. The apparatus of claim 1 wherein the reciprocable pump means further includes:

housing means having a cavity therein;

piston means reciprocable in the cavity, cooperating with the housing means to divide the cavity into the first and second pump chambers and operable to avoid significant shearing of the frangible particles, and operable to volumetrically enlarge one of the first and second pump chambers while volumetrically reducing the other of the first and second pump chambers; and variable speed drive means connected to the piston means and operable to reciprocate the piston means and enlarge and contract the first and second chambers at a uniform rate.

3. The apparatus of claim 2 further including heating means around the housing means and operable to maintain a uniform temperature therein.

4. The apparatus of claim 1 wherein the manifold means includes:

supply manifold mens communicating with the reservoir means having two branch conduits each of which communicates with a corresponding one of the first and second pump chambers and supply valve means for alternately permitting flow through each of the two branch conduits; and discharge manifold means communicating with the reservoir means and the first and second pump chambers, having two branch conduits each of which communicates with a corresponding one of the first and second pump chambers and discharge valve means for alternately permitting flow through each of the two branch conduits.

5. The apparatus of claim 4 wherein the control means actuates the supply valve means and the discharge valve means.

6. The apparatus of claim 5 wherein:

the supply valve means includes two pneumatically actuated valves, each valve in a corresponding branch conduit and operable between an open condition and a closed condition; and the control means actuates the two valves such that one valve is in the open condition and the other valve is in the closed condition.

7. The apparatus of claim 5 wherein:

the discharge valve means includes two pneumatically actuated valves, each valve in a corresponding branch conduit and operable between an open condition and a closed condition; and the control means actuates the two valves such that one valve is in the open condition and the other valve is in the closed condition.

8. In matrix preparation apparatus having matrix supply means, reservoir means for supplying a flow of frangible particulate material, and mixing means for dispersing the flow of frangible particulate material in the matrix, the improvement being means for metering the flow of frangible particulate material to the mixing means comprising:

cylinder means, having a pair of ends, a longitudinal axis, a coaxial bore, and a length;

supply manifold means having ends substantially coterminous with corresponding ends of the cylinder means and having a conduit communicating with the reservoir means;

discharge manifold means having ends substantially coterminous with corresponding ends of the cylinder means and having a conduit communicating with the mixing means;

a pair of cylinder end means, each end means being disposed at a corresponding end of the cylinder means, being operable to connect by longitudinally sliding movement a corresponding end of the cylinder means, the supply manifold means and the discharge manifold means, and having a supply passage providing communication between the corresponding end of the cylinder means and the corresponding end of the supply manifold means, a discharge passage providing communication between the corresponding end of the cylinder means and the corresponding end of the discharge manifold means, and an opening in longitudinal alignment with the axis and extending through the cylinder end means;

piston means slidably positioned in the coaxial bore of the cylinder means, having a shaft extending through the opening of each end means and defining first and second annular pump chambers in cooperation with the cylinder means and the pair of cylinder end means;

clamp means longitudinally engaging the pair of end means and operable to hold the end means, the cylinder means, the supply manifold means and the discharge manifold means together;

control means cooperating with the supply manifold means and the discharge manifold means to alternately connect one of the first and second pump chambers with the reservoir means and to simultaneously connect the other of the first and second pump chambers with the mixing means; and variable speed drive means releasably connected to the piston means for reciprocating the piston means in the cylinder means.

9. The matrix preparation apparatus of claim 8 wherein the variable speed drive means is connected to the piston means by a shaft coupling having a removable conically tapered shear pin.

10. The apparatus of claim 8 further including heating means around the cylinder means operable to maintain a uniform temperature therein.

11. The matrix preparation of claim 10 wherein the heating means includes:

a pair of heat sink portions mounted on the cylinder means so as to essentially surround the cylinder means, each sink portion being shorter than the cylinder means so that the cylinder means is received by each cylinder end means, and including a plurality of longitudinal fins extending generally radially from the cylinder means, each fin having a longitudinal opening; and a plurality of heating elements, each being received by a corresponding one of the longitudinal openings so as to be circumferentially positioned around the cylinder means.

12. The matrix preparation apparatus of claim 11 wherein:

each heat sink portion includes a longitudinally extending channel defined between two of the fins and adapted to receive one of the supply manifold means and the discharge manifold means.

13. The matrix preparation apparatus of claim 12 wherein each of the supply manifold means and the discharge manifold means is T-shaped and includes a manifold portion extending between the cylinder end means, the manifold portion being between a pair of the fins.

14. The matrix preparation apparatus of claim 11 wherein:

the clamp means includes a plurality of tie rods and each tie rod is positioned between a corresponding pair of the fins.

15. The apparatus of claim 8 wherein position sensing means cooperates with the piston means to indicate the longitudinal extremes of the piston means, to cause reversal of the variable speed drive means when an extremum is indicated and to actuate the control means.

16. The apparatus of claim 15 wherein the sensing means includes:

a laterally extending vane on the piston means; and a pair of limit switches spaced apart by a distance corresponding to the stroke of the piston means.

17. The apparatus of claim 8 wherein:

the supply manifold means includes supply valve means operable to selectively connect the conduit with one of the pair of end means;

the discharge manifold means includes discharge valve means operable to selectively connect the conduit with one of the pair of end means; and the control means actuates the supply valve means and the discharge valve means such that the conduit is connected to one of the end means and the other of the end means is connected to the mixing means.

18. The apparatus of claim 17 wherein:

the supply valve means includes a pair of valves operable between an open position and a closed position; and each valve is actuated between the open position and the closed position by a pneumatic actuator operably connected to the control means.

19. The apparatus of claim 17 wherein:

the discharge valve means includes a pair of valves operable between an open position and a closed position; and each valve is actuated between the open position and the closed position by a pneumatic actuator operably connected to the control means.

20. The matrix preparation apparatus of claim 17 further including:

a source of pressurized fluid;

a pneumatic supply valve actuator connected to the supply valve means;

a pneumatic discharge valve actuator connected to the discharge valve means; and control valve means connected to the source of pressurized fluid, the pneumatic supply valve actuator and the pneumatic discharge valve actuator, the control valve means being operable to regulate the flow of frangible particulate material to and from the first and second annular chambers.

21. A controlled delivery pump for metering a flow of frangible particulate material and adapted for rapid disassembly comprising:

cylinder means having a pair of ends, a longitudinal axis, a coaxial bore, and a length;

supply manifold means having ends substantially coterminous with corresponding ends of the cylinder means and having a supply conduit operable for connection to a reservoir;

discharge manifold means having ends substantially coterminous with corresponding ends of the cylinder means and having a discharge conduit;

a pair of cylinder end means, each end means being disposed at a corresponding end of the cylinder means, being operable to connect by longitudinally sliding movement a corresponding end of the cylinder means, the supply manifold means and the discharge manifold means, and having a supply passage providing communication between the corresponding end of the cylinder means and the corresponding end of the supply manifold means, a discharge passage providing communication between the corresponding end of the cylinder means and the corresponding end of the discharge manifold means, and an opening in longitudinal alignment with the axis and extending through the cylinder end means;

piston means slidably positioned in the coaxial bore of the cylinder means, having a shaft extending through the opening of each end means, defining first and second annular pump chambers in cooperation with the cylinder means and the pair of cylinder end means;

clamp means longitudinally engaging the pair of end means, the supply manifold means and the discharge manifold means;

control means cooperating with the supply manifold means and the discharge means to alternately connect one of the first and second pump chambers with the supply conduit and to simultaneously connect the other of the first and second pump chambers with the discharge conduit;

variable speed drive means releasably connected to the piston means for reciprocating the piston means in the cylinder means; and heating means around the cylinder means operable to maintain a uniform temperature therein.

22. The pump of claim 21 wherein position sensing means cooperates with the piston means to indicate the longitudinal extrema of the piston means, to cause reversal of the variable speed drive means when an extremum is indicated and to actuate the control means.

23. The pump of claim 22 wherein the sensing means includes:

a laterally extending vane on the piston means; and a pair of limit switches spaced apart by a distance corresponding to the stroke of the piston means.

24. The pump of claim 21 wherein:

the supply manifold means includes supply valve means operable to selectively connect the supply conduit with one of the pair of end means;

the discharge manifold means includes discharge valve means operable to selectively connect the discharge conduit with one of the pair of end means; and the control means actuates the supply valve means and the discharge valve means such that the supply conduit is connected to one of the end means and the other of the end means is connected to the discharge conduit.

25. The pump of claim 24 wherein:

the supply valve means includes a pair of valves operable between an open position and a closed position; and each valve is actuated between the open position and the closed position by a pneumatic actuator operably connected to the control means.

26. The pump of claim 25 wherein:

the discharge valve means includes a pair of valves operable between an open position and a closed position; and each valve is actuated between the open position and the closed position by a pneumatic actuator operably connected to the control means.

* * * * *